US009797185B2

(12) United States Patent
Abdul Lathief

(10) Patent No.: US 9,797,185 B2
(45) Date of Patent: Oct. 24, 2017

(54) SELF-LOCKING HANDRAIL SYSTEM

(71) Applicant: Century Glass LLC, Dubai (AE)

(72) Inventor: Arakkal Abdul Khader Abdul Lathief, Dubai (AE)

(73) Assignee: City Glass & Glazing (P) Ltd. (IN)

( * ) Notice: Subject to any disclaimer, the term of this patent is extended or adjusted under 35 U.S.C. 154(b) by 296 days.

(21) Appl. No.: 14/491,229

(22) Filed: Sep. 19, 2014

(65) Prior Publication Data

US 2015/0007514 A1 Jan. 8, 2015

Related U.S. Application Data

(63) Continuation of application No. 14/327,961, filed on Jul. 10, 2014, now Pat. No. 9,683,402, which is a (Continued)

(51) Int. Cl.
*E04F 11/18* (2006.01)
*E06B 3/54* (2006.01)
(Continued)

(52) U.S. Cl.
CPC ..... *E06B 3/549* (2013.01); *E04F 11/1812* (2013.01); *E04F 11/1846* (2013.01);
(Continued)

(58) Field of Classification Search
CPC ..... E06B 3/5481; E06B 3/549; E06B 3/5821; E06B 3/5871; E06B 3/62;
(Continued)

(56) References Cited

U.S. PATENT DOCUMENTS 2,304,423 A * 12/1942 Schiller ..... E06B 3/5821 52/204.7
3,155,205 A * 11/1964 Piace ..... E06B 3/5821 52/204.591
(Continued)

FOREIGN PATENT DOCUMENTS

AT EP 2940228 A1 * 11/2015 ..... E04F 11/1812
CA 1070569 A 1/1980
(Continued)

OTHER PUBLICATIONS

International Search Report for PCT/IB2004/002298 mailed Nov. 30, 2004.

*Primary Examiner* — Ryan Kwiecinski
(74) *Attorney, Agent, or Firm* — Fishman Stewart PLLC

(57) ABSTRACT

A self-locking handrail system includes a female profile and a male profile. The female profile includes a first leg, a first locking extension that is approximately parallel to the first leg, having a gap formed therebetween, and a first vertical leg extending from the first locking extension approximately orthogonal to the first locking extension. The male profile includes a second vertical leg, and a second locking extension extending from a free end of the second locking extension, forming a fulcrum. A panel is positioned between the first vertical leg and the second vertical leg. A bar is positioned between the panel and the second vertical leg, the bar having first and second surfaces opposite one another that are not parallel with one another, causing the female and male profiles to engage by tilting the second vertical leg outward from the panel and about the fulcrum.

20 Claims, 9 Drawing Sheets

Related U.S. Application Data continuation-in-part of application No. 14/148,188, filed on Jan. 6, 2014, now abandoned, which is a continuation of application No. 12/261,891, filed on Oct. 30, 2008, now Pat. No. 8,621,793, which is a continuation-in-part of application No. 10/566,536, filed as application No. PCT/IB2004/002298 on Jul. 15, 2004, now abandoned.

(51) Int. Cl.
*E06B 3/663* (2006.01)
*E06B 3/58* (2006.01)
*E06B 3/24* (2006.01)

(52) U.S. Cl.
CPC ..... *E04F 11/1853* (2013.01); *E06B 3/5821* (2013.01); *E06B 3/66304* (2013.01); *E04F 2011/1895* (2013.01); *E06B 3/24* (2013.01); *E06B 2003/5472* (2013.01); *Y10T 29/49826* (2015.01); *Y10T 29/49959* (2015.01)

(58) Field of Classification Search
CPC ..... E06B 2003/5463; E06B 2003/5472; E06B 2003/6226; E04F 11/1853; E04F 2011/1823; E04F 2011/1825; E04F 2011/1831; E04F 2011/1829; E04F 11/181; E04F 11/1812; E04F 11/1846; E04F 2011/1895
See application file for complete search history.

(56) References Cited

U.S. PATENT DOCUMENTS

| | | | | | |
|---|---|---|---|---|---|
| 3,455,080 | A | | 7/1969 | Meadows | |
| 3,774,363 | A | * | 11/1973 | Kent | B60J 10/70 52/204.597 |
| 3,881,290 | A | | 5/1975 | Bouchey | |
| 4,054,268 | A | * | 10/1977 | Sher | E04F 11/1812 256/24 |
| 4,524,978 | A | | 6/1985 | Mauser | |
| 4,612,743 | A | * | 9/1986 | Salzer | E06B 3/28 49/501 |
| 4,689,933 | A | | 9/1987 | Biro | |
| 4,793,110 | A | * | 12/1988 | Tucker | E02D 27/00 248/188.4 |
| 5,007,221 | A | | 4/1991 | Matthews et al. | |
| 5,617,695 | A | | 4/1997 | Brimmer | |
| 5,692,349 | A | | 12/1997 | Guillemet | |
| 5,713,159 | A | | 2/1998 | Schmidt | |
| 5,768,837 | A | | 6/1998 | Sjoholm | |
| 6,003,277 | A | | 12/1999 | Graham et al. | |
| 6,318,037 | B1 | | 11/2001 | Hansen | |
| 6,419,209 | B1 | * | 7/2002 | Shepherd | E04F 11/1851 256/24 |
| 6,792,724 | B2 | | 9/2004 | Burgess | |
| 6,848,225 | B2 | | 2/2005 | Lapierre | |
| 6,974,518 | B2 | * | 12/2005 | Hornung | E06B 3/24 156/109 |
| 7,040,062 | B2 | | 5/2006 | Emek | |
| 7,621,082 | B2 | | 11/2009 | Morton | |
| 8,621,793 | B2 | | 1/2014 | Abdul Lathief | |
| 2002/0011040 | A1 | | 1/2002 | Adachi et al. | |
| 2003/0070371 | A1 | | 4/2003 | Kobrehel | |
| 2003/0089054 | A1 | | 5/2003 | Hornung | |
| 2003/0159374 | A1 | | 8/2003 | Burgess | |
| 2004/0231255 | A1 | * | 11/2004 | Silverman | E06B 3/24 52/204.6 |
| 2005/0055906 | A1 | | 3/2005 | Barnard | |
| 2005/0246980 | A1 | | 11/2005 | Montero | |
| 2006/0143996 | A1 | | 7/2006 | Alvarado | |
| 2013/0240813 | A1 | * | 9/2013 | Bangratz | E04F 11/1851 256/24 |
| 2014/0072735 | A1 | * | 3/2014 | Jones | E06B 3/5814 428/34 |
| 2015/0110552 | A1 | * | 4/2015 | Yang | F16B 2/14 403/374.1 |
| 2015/0240851 | A1 | * | 8/2015 | Giacometti | F16B 9/023 403/374.3 |
| 2015/0267415 | A1 | * | 9/2015 | Zhou | E04F 11/1853 52/208 |
| 2016/0281366 | A1 | * | 9/2016 | Spence | E04F 11/1812 |
| 2016/0298337 | A1 | * | 10/2016 | Header | E04F 11/1853 |

FOREIGN PATENT DOCUMENTS

| | | | | | |
|---|---|---|---|---|---|
| CH | 710415 | A2 | * | 5/2016 | E04F 11/1812 |
| CN | 2295835 | Y | | 10/1998 | |
| DE | 2452087 | A1 | | 5/1976 | |
| DE | 29505023 | A1 | | 5/1976 | |
| DE | 2614803 | | | 10/1977 | |
| DE | 2614803 | A1 | | 10/1977 | |
| DE | 2825926 | A1 | * | 1/1980 | E06B 3/62 |
| DE | 29505234 | U1 | | 7/1995 | |
| DE | 102009003866 | A1 | * | 11/2010 | E04F 11/1812 |
| DE | 102010053409 | A1 | * | 6/2012 | E04F 11/1812 |
| EP | 011901 | A1 | | 6/1980 | |
| FR | 2996573 | A1 | * | 4/2014 | E04F 11/1812 |
| GB | 2144477 | A | | 3/1985 | |
| GB | 2178470 | A | | 2/1987 | |
| GB | 2179591 | A | | 3/1987 | |
| GB | 2237600 | A | | 5/1991 | |
| IT | WO 2015145477 | A1 | * | 10/2015 | E04F 11/1812 |
| IT | EP 3009580 | A1 | * | 4/2016 | E04F 11/1812 |
| JP | 10184208 | | | 7/1998 | |
| JP | 11256942 | | | 9/1999 | |
| WO | WO-2005010310 | A1 | | 2/2005 | |

* cited by examiner

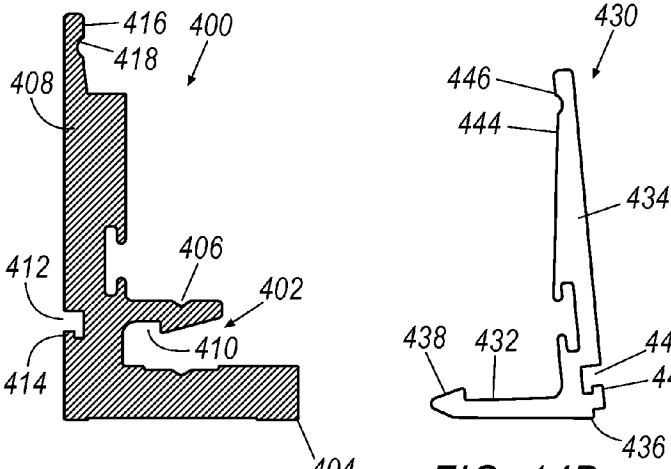
FIG. 14A
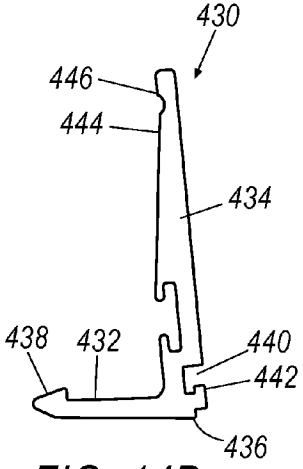
FIG. 14B
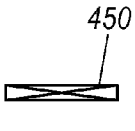
FIG. 14C
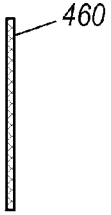
FIG. 14D
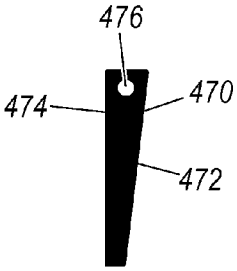
FIG. 14E
FIG. 14F
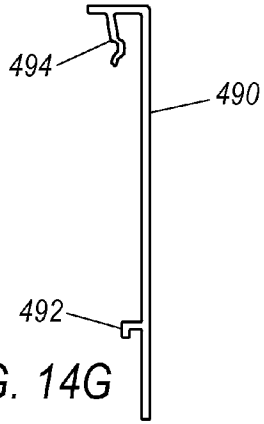
FIG. 14G

SELF-LOCKING HANDRAIL SYSTEM

CROSS-REFERENCE TO RELATED APPLICATIONS

This application is a continuation of and claims priority to U.S. patent application Ser. No. 14/327,961, filed on Jul. 10, 2014, which is a continuation-in-part of U.S. patent application Ser. No. 14/148,188, filed on Jan. 6, 2014, which claims the benefit of U.S. patent application Ser. No. 12/261,891, filed on Oct. 30, 2008, which is a continuation-in-part of U.S. patent application Ser. No. 10/566,536, filed Jan. 30, 2006, which claims priority to International Application No. PCT/IB2004/002298, filed Jul. 15, 2004, which are incorporated herein by reference in their entirety.

BACKGROUND

1. Field

The current disclosure relates to a unique and compact self-lock glazing system composed of two aluminum extrusion profiles—a male profile and a female profile—designed in such a way to self-lock glass panels using beadings. The mechanism functions when a glass panel is positioned on setting blocks over the flat surface of the upper leg of the said female profile—with spacers between the vertical leg of the said female profile and the said glass panel (as illustrated in FIGS. 3, 4, 5, 6, 7, 8) and the said male profile with the locking tip facing upward on its horizontal leg inserted into the gap between the upper leg and the lower leg of the said female profile against the female locking tip above. The locking tips of both male and female profiles are then engaged by tilting the vertical leg 30 of the said male profile outward about its built-in fulcrum, and inserting wedges into the space so created between the said glass panel and the vertical leg of the male profile, for keeping the said glass panel locked in position. The mechanism further tightens grip on the edges of the said glass panel when the said spacers and wedges are replaced by rubber beadings of appropriate resilience (which is mandatory for glazing to avoid touching metal, to allow expansion and to absorb impacts).

The introduction of the said rubber beadings lends a unique dynamism to the mechanism. The inherent resilience of rubber beadings causes a mating action in the locking chamber and the resulting equal and opposite reactions keeps the glass panel in equilibrium between the vertical tips of both the said male and female profiles by means of the built-in fulcrum. This balancing act of forces remains in the locking system throughout the life of the beadings.

2. General Background

U.S. Pat. No. 5,007,221 entitled "snap-in glazing pocket filler" disclosed a snap-in pocket filler for use with a structural frame member having an unused glazing pocket, or for use as gap filler on aluminum profiles to cover the unused area for aesthetic reason.

It was noticed that a proper glazing system was lacking in the market to meet the increasing demand for thicker glazing (e. g. shop fronts and partitions) and it has become a necessity for those skilled in the art to develop a system which must be simple, technically safe and aesthetically impressive.

The following U.S. patents are incorporated herein by reference:

TABLE

| PAT. NO. | TITLE | ISSUE DATE |
|---|---|---|
| 3,774,363 | Glazing Window or Windscreen Openings, Particularly in Vehicle Bodies | Nov. 27, 1973 |
| 3,881,290 | Glazed Impervious Sheet Assembly and Method of Glazing | May 06, 1975 |
| 4,689,933 | Thermally Insulated Window Sash Construction for a Casement Window | Sep. 01, 1987 |
| DE2614803 | GLASFALZLEISTE | Oct. 27, 1977 |
| JP10184208 | Fitting to Which Glass and the Like can be Easily Attached/Detached | Jul. 14, 1998 |
| JP11256942 | Glazing Gasket | Sep. 21, 1999 |
| UK2237600 | Preventing Removal of Glazing Bead | May 08, 1991 |

BRIEF SUMMARY

Aluminum glazing profiles generally available in the market are intended for standard window glazing only. These profiles are used by many people for bigger partition walls with thicker glazing, compromising safety, quality and aesthetic appeal as no other options are available for glazing big partition walls with thicker glass panel than window pane glasses. For maximum visibility of the showrooms, designers insist on frameless glazing with thin frames around the glass panel. Technicians use U channels, in which glass panels are allowed to stand free but these tend to move horizontally due to loose fixing with silicone at the ends.

Some professional pioneers like Dorma (Germany) developed heavy profiles for thicker glass application which require fastening by screws that further should be covered for aesthetic reasons and consequently the work becomes complicated, laborious and eventually expensive. In view of the above factors and considering the demand for faster glazing, the current disclosure emphasizes the issue of safety while addressing the importance of aesthetic appeal, allowing enough clearance for glazing (so that one could decide the glass size before installing frames at site) and making site installation easy.

BRIEF DESCRIPTION OF THE SEVERAL VIEWS OF THE DRAWINGS

For a further understanding of the nature, objects, and advantages of the present disclosure, reference should be had to the following detailed description, read in conjunction with the following drawings, wherein like reference numerals denote like elements and wherein:

FIG. 14A illustrates a female profile;

FIG. 14B illustrates a male profile;

FIG. 14C illustrates a packing material;

FIG. 14D illustrates a rubber separator;

FIG. 14E illustrates a tapered or trapezoidal bar;

FIG. 14F illustrates a cladding material;

FIG. 14G illustrates a cladding or clip;

DETAILED DESCRIPTION

Figures 1A, 2A, 3, 4, 5, 6A, 7A:
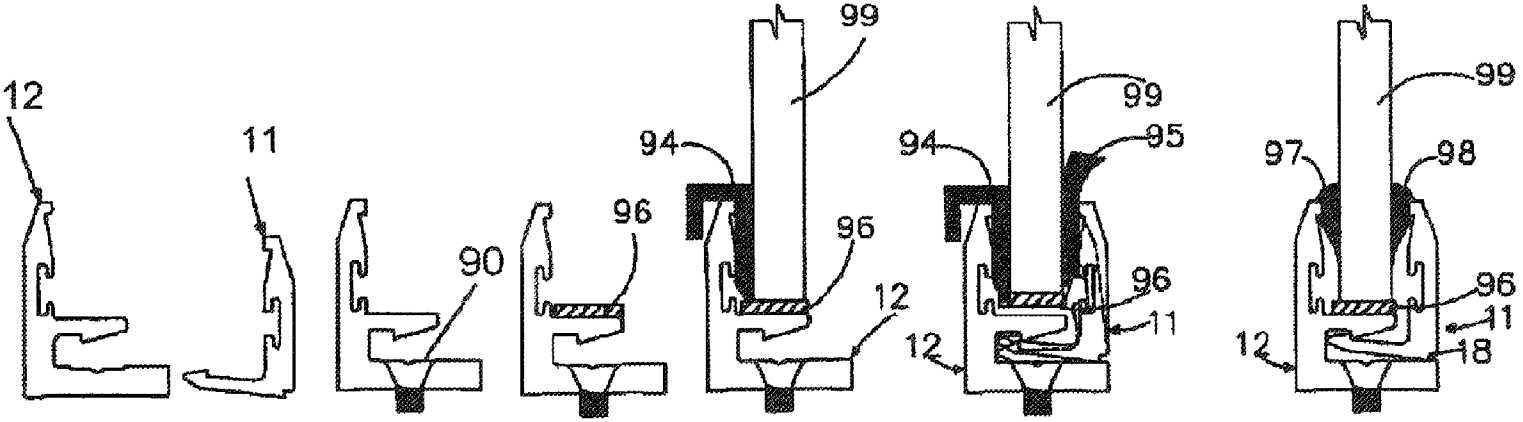
FIG. 1A is a female profile.
FIG. 2A is a male profile.
FIG. 3 is a structural fixing of the female profile using a screw.
FIG. 4 is glass packing on the female profile (minimum 2 per glass panel)
FIG. 5 is a glass panel (suitable to the frame size) placed over the female profile.
FIG. 6A is the horizontal leg of the male profile introduced through the gap between the upper leg and the lower leg of the female profile and the vertical leg of the male profile is tilted outward on its built-in fulcrum to engage the lock, then wedges are introduced to keep the lock engaged so that glass panel is locked in position.
FIG. 7A is a view of grooved rubber beadings which are introduced in between the gaps of profiles from both sides of the glass panel.
Figure 8:
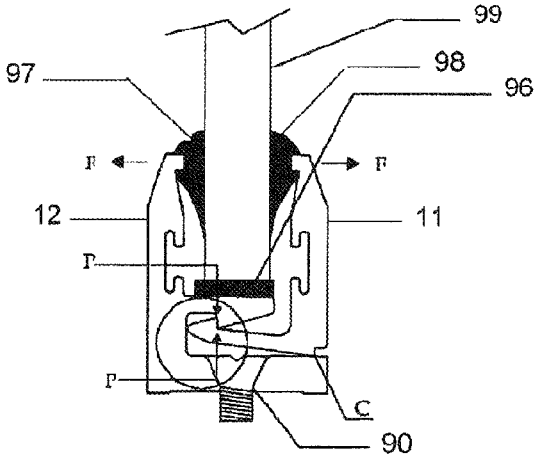
FIG. 8 is a side view of the mechanism of the glazing system.
Figure 9:
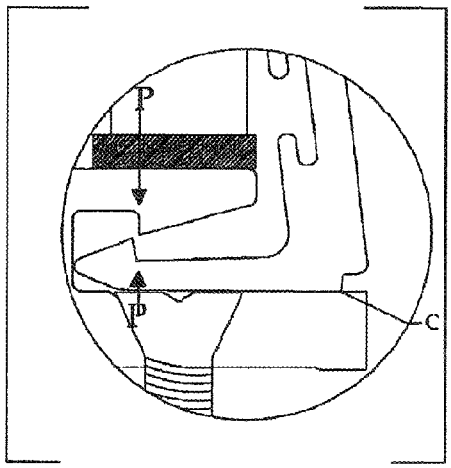
FIG. 9 are details of the locking tips of FIG. 8.

The self-lock glazing system consists of two extruded aluminum profiles, a male profile 11, FIG. 2A and a female profile 12, FIG. 1A as described in the succeeding paragraphs, designed in such a way to create a secure space for keeping glass panels safely and tightly in position. An important aspect is that when a glass panel 99, FIG. 7A is placed on the upper leg 70 of the female profile 12 and the male profile 11 is inserted and rubber beadings 97, 98 are forced in (by hand) between the said glass panel 99 and the profiles 12, 11 respectively creates outward forces F, FIG. 8 on the vertical tips of the said profiles (forcing them apart). The turning moment at the pivotal fulcrum 18 of the said male profile 11 forces the locking system together because of the complementary locking tips 73 and 71 provided on the profiles as a result, the system interlocks and thus arrest the profiles (11 and 12) in position; eventually the said glass panel 99 held in guard (under the pressure of the beadings 98 and 97) of the said vertical tips (32, FIG. 2B and 67, FIG. 1B) remains locked.

Figure 1B:
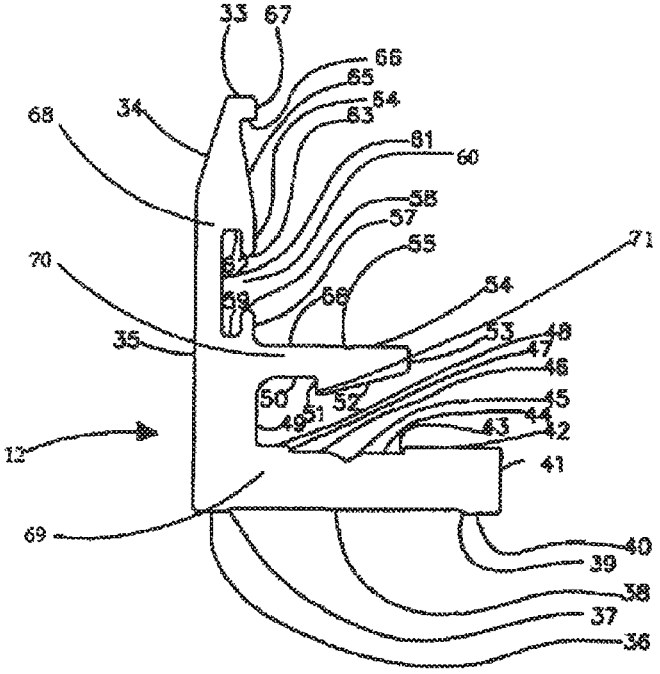
FIG. 1B is a female profile with reference characters.

The self-lock glazing system comprising:

a) A female profile 12, FIG. 1B, the female profile 12 is a right angled profile having a lower leg 69 as base, an upper leg 70 and an upward vertical leg 68. The upper leg 70 is the horizontal cantilever extension from the lower half portion of the vertical leg 68.

The vertical leg 68 originates from the horizontal lower leg 69 at the base and has a vertical face 35 which ends at about three-fourth the height of the vertical leg 68 to join an inclined surface 34 which terminates at the horizontal tip 33 with adjoining vertical face 67. The vertical face 67 acts as the link for transfer of forces between the glass panel 99, FIG. 5 and the female profile 12 and also helps to retain the rubber beading. The vertical face 67 is followed by a horizontal face 66 below that ends to a sloping face 65 which leads to the inside wall 64 of the vertical leg 68 that extends down to form a groove 60.

The said groove 60 comprises an upper projection 63, an upper recess 62, followed by the vertical wall 61 which is parallel to the exterior wall 35, a lower recess 59 and a bottom projection 58. The bottom projection 58 is followed by another vertical face 57 that curves down to join the upper face 56 of the upper leg 70.

The upper leg 70 which is the horizontal cantilever extension from the lower half portion of the vertical leg 68, has an upper flat surface formed by 56 and 54 and a groove 55 in between, and this leg 70 terminates approximately at two-thirds of the length of the lower leg 69 at tip 53 and its bottom has a downwardly sloping protrusion 52 with a female locking tip 71 with a mating face 51 followed by an upper horizontal surface 50 that curves down to the vertical wall 49 to form the locking chamber facing downward to the gap formed by the remaining portion of the inside wall 49 and the adjacent upper surface 48 up to 42 of the lower leg 69; this gap provides access to the said locking chamber.

The said vertical faces 67, 64, 57 and 49 are all in a same straight line and defines the inside wall of the said female profile 12. The recess formed by the sloped face 65 is for accommodating the allowances provided in the grooved rubber beadings.

The top surface of the lower leg 69 is flat in general, and this top surface starts with a horizontal surface 48 adjacent to the inner vertical wall 49 and this horizontal surface 48 defines the general level of the top surface. On the other end of the leg there is another horizontal surface 42 which is of same level as 48. The horizontal surface 42 at the other end plays a vital role in the system since it acts as the base for acting the built-in fulcrum 18 in the said male profile 11. The upper surfaces 48 and 42 of the lower leg 69 have two lower horizontal faces 46 and 44 in between with a 'v'-shaped groove 45 at its centre. The recessed surface 46 is connected to the surface 48 with an inclined surface 47. The horizontal recessed surface 44 is connected with the surface 42 by an inclined 43. The 'v'-shaped groove 45 at the centre acts as a guidance for drilling holes for countersunk screws 90 for fastening the female profile 12 to the structure. There is another 'v'-shaped groove 55 on the flat surface on top of the upper leg 70 that facilitates ease of drilling a hole for access to the 'v' shaped groove 45 vertically below. The 'v'-shaped grooves 45 and 55 are required to ensure precision and accuracy of the installation of the glazing system and also to make drilling easier and to the point.

Figure 2B:
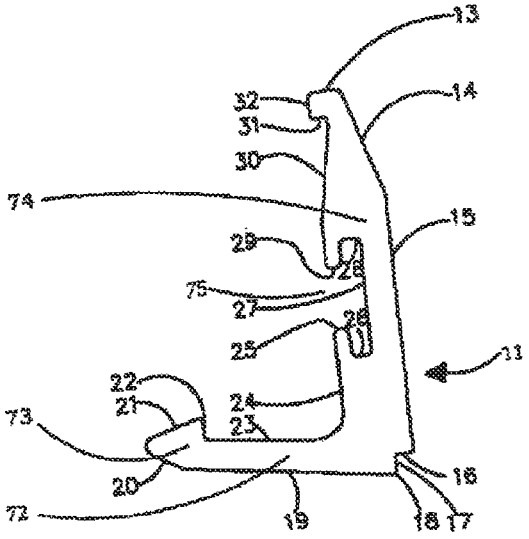
FIG. 2B is a male profile with reference characters.
Figure 6B:
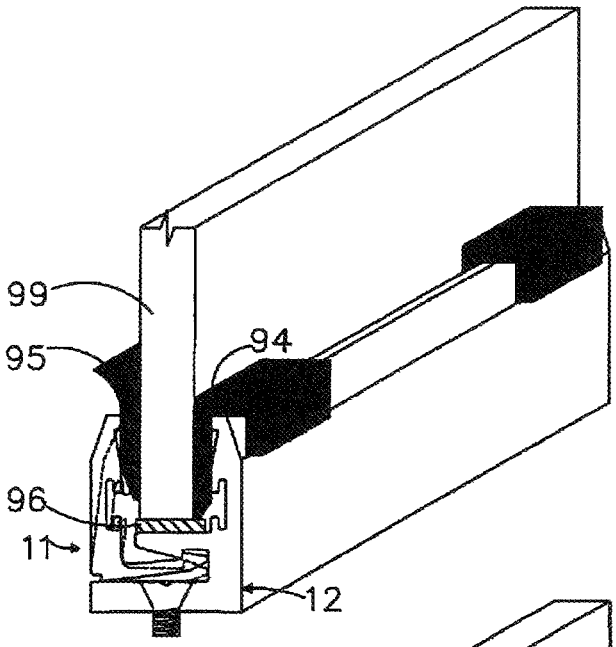
FIG. 6B is a perspective view of the self-lock glazing system showing the spacers.
Figure 6C:
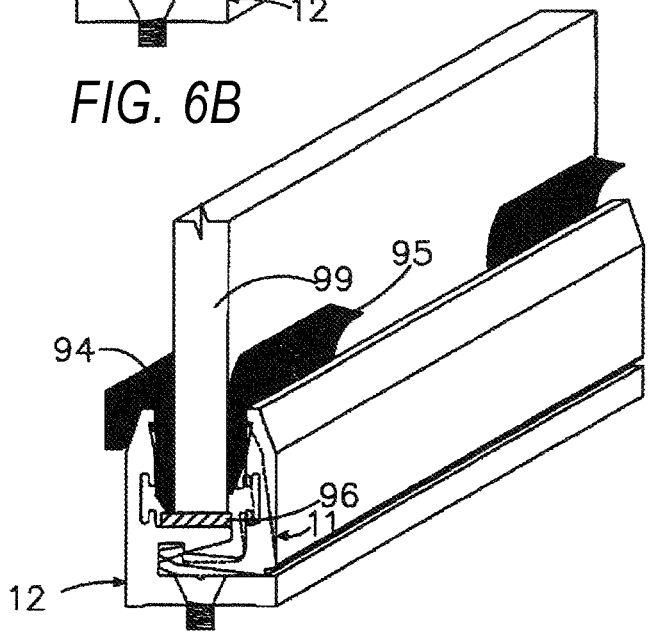
FIG. 6C is a perspective view of the self-lock glazing system showing the wedges.
Figure 7B:
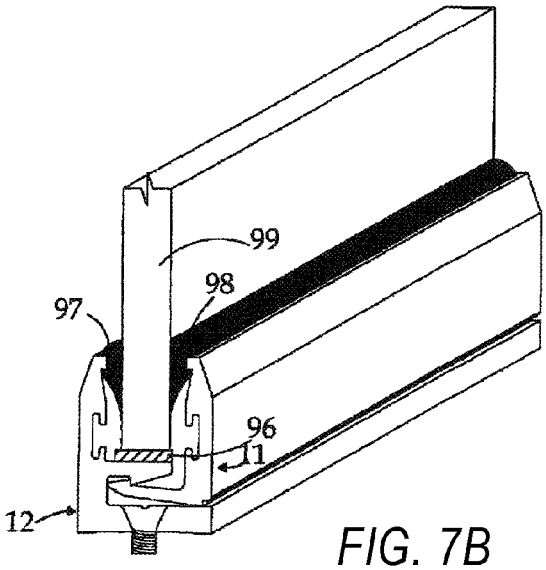
FIG. 7B is a perspective view of the self-lock glazing system with glass panel in position and the rubber beadings are introduced.

Adjacent to the horizontal surface 42, a vertical face 41 goes down to the bottom surface of the horizontal leg 69 and this vertical surface 41 comes in the same line with the outer surface 15 of the said male profile 11 when the system is engaged. The bottom surface of the lower leg of the said female profile 12 has two symmetrical projections 36 and 40 at the ends with recess 38 at centre for proper seating. The recess 38 is connected to projection 36 and 40 with inclined surfaces 37 and 39 respectively.

b) A male profile 11, FIG. 2B, the male profile 11 is an acute angled profile consisting of a horizontal leg 72 with a locking tip 73 at one end and vertical leg 74 at the other end. The horizontal leg 72 is the base with a lower surface 19 starting from the lower face 20 of the locking tip 73, and ends with the built-in fulcrum 18 with an adjoining recess formed by vertical face 17 and a horizontal face 16. The vertical leg 74 starts from the said recess with a surface 15 inclined forward and ends at another inclined face 14 which is further inclined inward to join the horizontal tip 13.

The locking tip 73 comprising an upward sloping surface 20 turns to form another upward sloping surface 21, and an adjoining dropping down face 22 combines to form a unique shape to the locking tip 73. The upper surface 23 of the horizontal leg 72 curves upward to join the inner vertical wall 24 which extends up to a groove 75.

The said groove comprising a lower projection 25, an upper projection 29, a lower recess 26, an upper recess 28 with a vertical wall 27 that is parallel to the exterior wall 15, a top projection 29, joins the interior wall which slopes upward forming an inclined surface 30 which terminates at the horizontal surface 31. The horizontal surface 31 ends to a vertical face 32 that joins the horizontal tip 13.

The horizontal tip 13 together with a vertical surface 32 and a bottom surface 31 helps to retain the rubber beadings.

The mechanism functions when a glass panel 99 is positioned on packing 96 over the upper leg 70 of the said female profile with spacers 94 between the vertical leg 68 of the said female profile 12 and the said glass panel 99, and then inserting the horizontal leg 72 of the said male profile 11 with its locking tip 73 facing upward into the gap between the lower leg 69 and upper legs 70 of the said female profile, then engaging the locking tips of both male and female profiles by tilting the said male profile 11 on its built-in fulcrum 18 by pulling the vertical leg 74 outward and introducing the wedges 95 into the space so created between the said glass panel 99 and the said vertical tip 32 of the said male profile 11 to keep the locks engaged and thus the said glass panel 99 locked in the system; the mechanism further tightens its grip on the edges of the locked glass panel 99 when the spacers 94 and wedges 95 are replaced by rubber beadings 97 and 98 of appropriate resilience which enables the said glass panel 99 to remain in an equilibrium throughout the life of the beading. The vertical plane passing through the centre of the glass panel 99 will intersect both the male profile 11 and female profile 12, and also intersect the gap of the female profile 12 and the leg 72 of the male profile 11. Then the horizontal tip 33 of the vertical leg 68 of the said female profile 12 and the horizontal tip 13 of the vertical leg 74 of the said male profile 11 are located at the same height when the glass panel 99 is positioned and the lock is engaged by tilting the said male profile 11 on its built-in fulcrum 18 by pulling the vertical leg 74 outward and introducing the wedges 95 into the space so created between the said glass panel 99 and the said vertical tip 32 of the said male profile 11 to keep the locks engaged and thus the said glass panel 99 locked in the system.

METHOD OF INDUSTRIAL APPLICATION

The scientific principles used are the Newton's Law of Motion, the property of elasticity of the rubber and the transmission of the rotational moments of the moving parts around the fulcrum. The following explanation is read in relation to FIG. 8:

F—Outward force (due to the resilience of rubber beading)

P—Inward force (creating the locking)

C—Fulcrum point

Insertion of the rubber between the glass panel and the upper tips of the vertical legs of profiles creates outward forces (F) to the legs of both profiles forcing them apart.

A turning moment at the pivotal fulcrum (C) forces the locking system together (P). The locking system functions due to the combination of a pair of hooking tips and the fulcrum built in the legs of the male and female profiles mating in the locking chamber while retaining the pivotal mating profile (male) firmly in position and the glass panel which is under the grip of the said vertical tips are eventually remain locked.

The pre-determined variables are the sizing of the glass panel and that of the rubber beading. In this arrangement any external forces applied due to conditions like wind or vibrations caused by physical movements—whose action may act to dislodge the glass from its set position—only acts to further tighten the fastening mechanism of the system to arrest the glass panel in position.

Figure 10A:
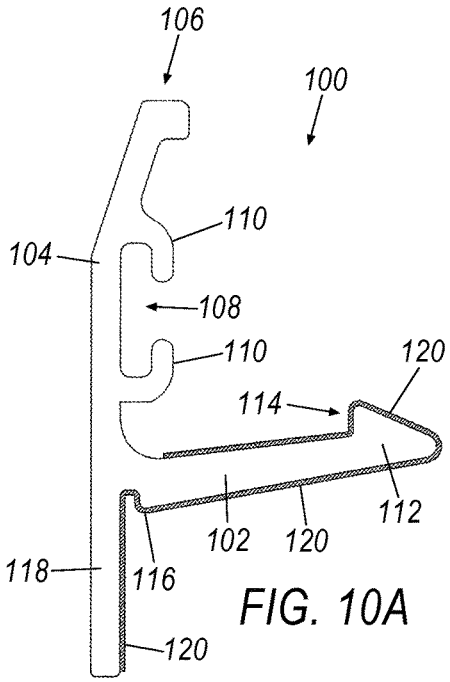
FIG. 10A includes a male profile having a thermal break material.

FIG. 10A illustrates a male profile 100 having a male profile leg or locking extension 102, and a leg 104 extending therefrom and having a tip 106. Leg 104 includes a cavity section 108 that is formed in part by clip segments 110. Locking extension 102 includes a locking or engagement tip 112 having a locking face 114 that engages male profile 100 in an assembly, as will be described. A fulcrum 116 is formed as part of locking extension 102 that is proximate where locking extension 102 is attached to leg 104. An additional cover or leg 118 extends from leg 104 that, in one example, is included to provide an improved aesthetic design to an overall assembly of components by providing a generally uninterrupted visible exterior. In the illustrated example, male profile 100 includes a thermal break material 120 that covers at least a portion of male profile 100, such as locking extension 102 and additional leg 118.

Figure 10B:
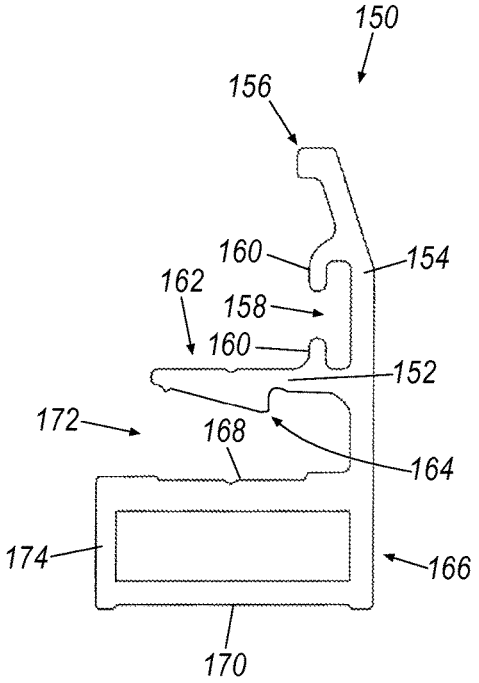
FIG. 10B includes a female profile configured to engage with the male profile of FIG. 10A.

FIG. 10B includes a female profile 150 configured to engage with male profile 100 of FIG. 10A. Female profile 150 includes an upper leg or locking extension 152 and a leg 154 extending therefrom, leg 154 having a tip 156. Leg 154 includes a cavity section 158 formed in part by clip segments 160. Locking extension 152 includes a locking or engagement tip 162 having a locking tip or face 164 that engages in an assembly that includes male profile 100. Female profile 150 includes a base structure 166 having an upper surface 168 and a lower surface 170. A gap 172 is formed between upper surface 168 of base structure 166 and locking extension 152.

Figure 11:
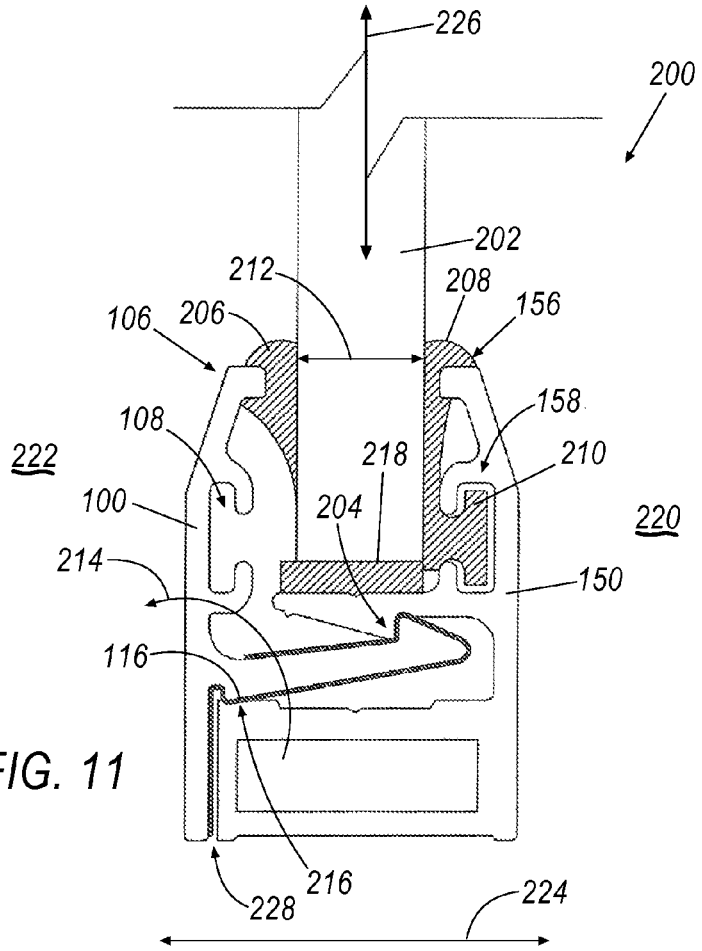
FIG. 11 illustrates a glazing assembly having engaged male and female profiles.

FIG. 11 illustrates a glazing assembly 200 having male profile 100 engaged with female profile 150. A panel or window 202 is positioned between tip 106 of male profile 100, and tip 156 of female profile 150 that, in the illustrated example, are approximately opposite one another. As shown, male profile 100 engages with female profile 150 at an engagement or contact location 204, which is defined by an interface region between locking face 114 of male profile 100, and locking face 164 of female profile 150.

A bead 206 is positioned between tip 106 and panel 202, and a bead 208 is positioned between tip 156 and panel 202. In the illustrated example, bead 208 includes an extension or capture material 210 that is positioned within cavity section 158. As such, bead 208 is captured or coupled to female profile 150, and may be captured thereto even without the presence of panel 202. Bead 206, on the other hand is illustrated as captured between tip 106 and panel 202 but does not extend into cavity section 108, as does material 210 of bead 208. However, it is contemplated that either or both of beads 206, 208 may include a material such as material 210 that is fit into and captured by respective cavity sections 108 and 158.

Beads 206 and 208 are fabricated from an elastically compressible and resilient material such as a rubber-type compound. Accordingly, each is installed into assembly 200 such that an outward force 212 results from compression that is applied against each of beads 206, 208. Force 212 thereby causes tips 106, 156 to force apart from one another. As such, male profile 100 is caused to rock or rotate 214 and about fulcrum 116, which abuts against a point or contact location 216 of female profile 150. Contact location 216, as illustrated, is on upper surface 168 of base structure 166. Accordingly, the rocking 214 about fulcrum 116 causes a locking engagement at engagement location 204 and between locking face 164 of female profile 150, and locking face 114 of male profile 100. That is, panel 202 is positioned between the first and second tips 106, 156, and outward forces 212 cause female and male profiles 150, 100 to engage by tilting leg 104 outward from panel 202 and about fulcrum 116. In one example, panel 202 is positioned on a base material or packing 218, that may provide dampening (to avoid shock to panel 202) to reduce damage to panel 202 during installation and use.

As can be appreciated, typically a window or panel 202 serves not only as a wind break in a structure (such as a residence or other building), but also to reduce an amount of heat transfer between both sides of the assembly. For instance, in one example, assembly 200 may be positioned to reduce the amount of heat transfer between an outside area 220 and an inside area 222. In this example, outside area 220 may be very cold, such as during winter in a cold climate, and may be at a temperature of −10° C., in an example. Inside area 222, on the other hand, may be at room temperature of 22° C., for example. Thus a temperature differential of 33° C. exists, in this example.

In another example, the direction of heat transfer may be reversed, such as may occur in summer months or in a very hot climate. For instance, in one example, assembly 200 may be positioned to reduce the amount of heat transfer between an inside area 222 and an outside area 220. In this example, outside area 220 may be very warm, and may be at a temperature of 42° C., in an example. Inside area 222, on the other hand, may be at room temperature of 22° C., for example. Thus a temperature differential of 20° C. exists, in this example.

As such, heat may transfer in a direction 224 that is generally orthogonal or transverse to a main axis 226 of panel 202, the direction of which is dependent on relative temperatures between one side of the assembly and the other. Thus, heat may transfer orthogonally through panel 202 and also through other components of assembly 200. As can be seen in assembly 200, conduction heat transfer from male profile 100 to female profile 150 occurs through beads 206, 208 (and panel 202), and also through locations or areas of direct contact therebetween. That is, engagement area 204 is one location where conduction occurs, and contact location 216 is another location where conduction occurs. Conduction heat transfer is relatively limited between beads 206, 208 and panel 202 because beads 206, 208 because the resilient material of beads 206, 208 is generally quite low (such as below 2 W/m-K). Thus, contact location 204 and contact location 216 represent at least two locations in assembly 200 that may have an increased propensity to conduction heat transfer.

As such and as described, thermal break material 120 is positioned between female profile 150 and male profile 100, and in one example material 120 covers at least a portion of male profile 100. In such fashion, an amount of conduction heat transfer is reduced between male profile 100 and female profile 150 because thermal break material 120 causes an interruption in the heat transfer path between inside area 222 and outside area 220. To reduce the amount of heat transfer, thermal break material 120 has a thermal conductivity that is lower than materials of male profile 100 and female profile 150. In examples, thermal break material is ABS or polycarbonate, or other material such as plastic. Plastic may include a synthetic material from a wide range of organic polymers such as polyethylene, PVC, nylon, etc., that can be molded into shape while soft and then set into a rigid or slightly elastic form. In general, the thermal break material typically has a low thermal conductivity relative to metals. For instance, profiles 100, 150 may be made of aluminum or other metal that may have a thermal conductivity greater than 100 W/m-K. Plastic, on the other hand, typically is below 2 W/m-K.

In one example, thermal break material 120 is attached directly to the male profile 100. That is, thermal break material 120 may be thermally bonded directly to male profile 100 in at least the areas of contact between profiles 100, 150, such as contact location 204 and contact location 216. In another example, thermal break material 120 is an extra item that is not directly bonded to male profile 100, but instead added to male profile 100 during assembly. Regardless, as shown, thermal break material 120 may be included over areas of male profile 100 in addition to contact location 204 and contact location 216, to ensure that any inadvertent contact between profiles 100, 150 will not be direct between the materials of each of profiles 100, 150 once assembled into assembly 200.

For instance, assembly 200 includes a gap 228 between additional leg 118 of male profile 100, and a face 174 of base structure 166. Gap 228 may be generally less than 1 mm in thickness and in one example, is 0.25 mm. As stated, additional leg 118 provides a generally uninterrupted exterior surface for male profile 100 that extends along face 174, for aesthetic purposes. As such and as a few examples, component tolerances, component distortion during assembly (components may be damaged or plastically deformed), and component distortion during use (such as in heavy wind or by pressure being placed by objects placed against assembly 200), may cause additional leg 118 to come into contact with face 174. Thus, thermal break material 120 may be included on additional leg 118, and in other portions of male profile 100 that may come into contact with female profile 150 after the assembly 200 is formed. Accordingly, the total amount of heat transfer between inside area 222 and outside area 220 is reduced, when compared to such an assembly that does not include thermal break material 120.

Self-locking glazing system or assembly 200 is fabricated, in one example, by engaging locking extension 102 of male profile 100 with locking extension 152 of female profile 150, positioning thermal break material 120 between the male and female profiles 100, 150, and positioning panel 202 using beads 206, 208 between tips of the male and female profiles 106, 156 to engage male and female profiles 100, 150 against thermal break material 120.

Figure 12:
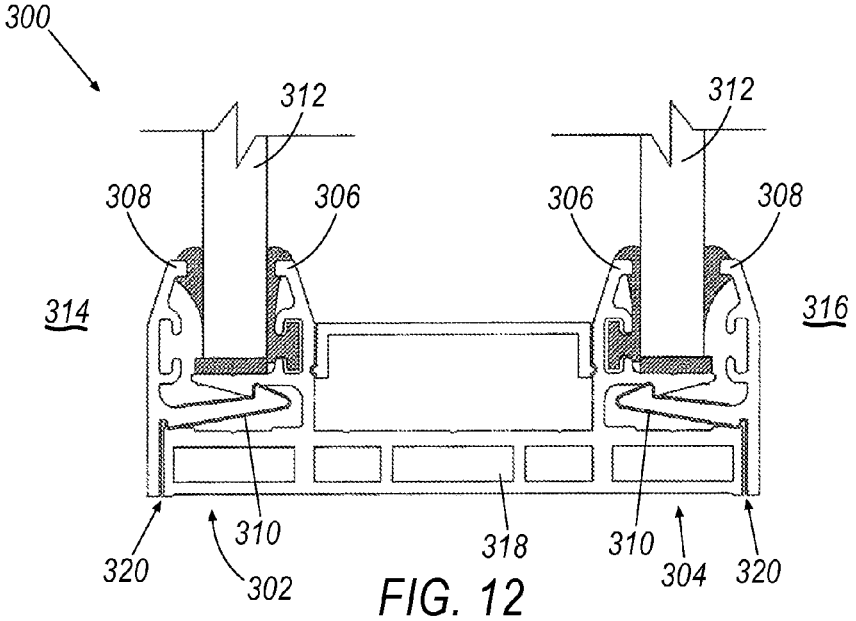
FIG. 12 illustrates a self-locking glazing system having two assemblies.

Referring to FIG. 12, a self-locking glazing system 300 may include two assemblies as previously disclosed, such as assembly 200. System 300 may include a first assembly 302 and a second assembly 304, each of which includes generally the features as described above with respect to assembly 200. That is, each assembly 302, 304 may include a respective female profile 306, male profile 308, and thermal break material 310 positioned therebetween. When respective panels 312 are positioned as described above and between tips in each assembly, the male and female profiles are caused to engage against the thermal break materials 310. As such, an amount of heat transfer between an inside area 314 and an outside area 316 is reduced still further because of the additional thermal barrier provided and the respective thermal break materials 310.

In one example, system 300 includes a common base 318 that forms both female profiles 306. Accordingly, gaps 320 are formed between each male profile 308 and common base 318. As such, thermal break materials 310 may extend on each male profile 308 such that any inadvertent contact in the gaps 320 is first met with a thermally resistive material. Female profiles 306 each further comprises a respective base structure having an upper surface and a lower surface, such that gaps are formed between each of the respective upper surface and the locking extension of the female profiles 306. A fulcrum is formed in each of the male profiles, where each locking extension extends from a respective leg, and each locking extension extends into a respective gap. Each fulcrum forms a contact location with the upper surface of the respective base structure where the respective thermal break material is positioned between the female profile and the male profile.

Figure 13:
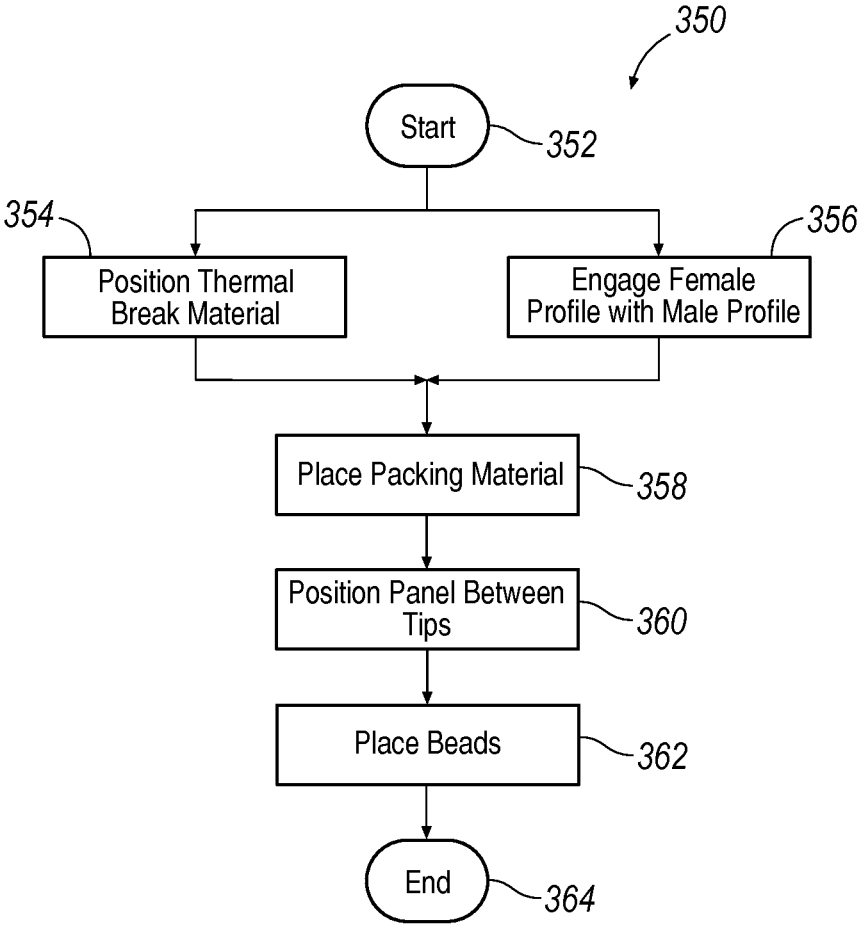
FIG. 13 illustrates a method of fabricating a glass handrail assembly.

FIG. 13 illustrates a method 350 of fabricating a self-locking glazing system. Starting at block 352, method 350 includes a block to position a thermal break material 354, and a block to engage the female profile with the male profile 356. Blocks 354 and 356 are illustrated in parallel with one another, but it is contemplated that actions in each block 354, 356 may be conducted in one order, or another order. That is, according to one example, the thermal break material, such as thermal break material 120 described above, may be affixed to locking extension 102 prior to engagement of the male and female profiles 100, 150. However, in another example, thermal break material 120 may be placed between the male and female profiles during the assembly process. For instance, in one example, thermal break material 120 is a relatively flexible material that is draped over locking extension 102 such that, when male profile 100 is engaged with female profile 150, the thermal break material 120 is pressed in and positioned therebetween and at the contact locations 204, 216. In such fashion, thermal break material 120 is positioned between profiles 100, 150 such that an amount of conduction heat transfer within assembly 200 is interrupted generally along direction 224. After engagement of profiles 100, 150 with thermal break material 120 positioned therebetween, at block 358, packing material such as base or packing material 218 is positioned on locking extension 152 of female profile 150. Panel 202 is positioned between tips 106, 156 at block 360. At block 362, beads 206, 208 are placed between panel 202 and respective tips 106, 156. In examples, one or both beads 206, 208 may be further retained by having a capture material, such as capture material 210 of bead 208, within cavity section 158. At block 364, assembly process 350 ends.

In operation, assembly 200 thereby tightens a hold on panel 202 when wind or other pressure is placed thereagainst. That is, as wind or pressure is brought to bear against panel 202 (generally orthogonally to main axis 226 but the direction may be in any vector against panel 202), the force causes slight motion against male profile 100, causing rotation about fulcrum 116, thereby causing engagement tip 112 of male profile 100 to further engage against engagement tip 162 of female profile 150. Thus, as external force is applied to the structure, the overall structure increases its grip on panel 202, resulting in the self-locking operation or mechanism.

Further, beads 206, 208 may further reduce an amount of heat transfer in assembly 200 by adding thermal resistance between tips 106, 156 and panel 202. As such, beads 206, 208 may be customized based on desired resiliency and based on mechanical engagement within assembly 200 (providing adequate reaction forces during operation) and/or based on a desired amount of thermal resistance. Further, beads 206, 208 may be modifiable such that other designs may be provided based on conditions of use. For instance, in a hot or dusty environment, it may be desirable for beads 206, 208 to also provide a dust barrier such that dust does not pass through the assembly and indoors.

As such, a self-locking glazing system includes a female profile having a first locking extension and a first leg extending therefrom, the first leg having a first tip. The system includes a male profile having a second locking extension and a second leg extending therefrom, the second leg having a second tip that is approximately opposite the first tip. A thermal break material is positioned between the female and male profiles. When a panel is positioned between the first and second tips using the beads 206, 208, the female profile and the male profile are caused to engage against the thermal break material.

The previously disclosed assemblies were described in applications useful for containing glass panels for applications such as for a window in a building. However, due to the ability of the assembly to grip the panel, and increase the grip when transverse forces are applied to the panel (due to the self-locking nature of the assembly), other uses may be considered as well. For instance, in one example a self-locking handrail assembly includes the disclosed panel as a handrail for, for instance, a stairwell or along an upper portion of a wall.

FIGS. 14A-14G illustrate components of a self-locking handrail assembly that may be incorporated into various exemplary designs. FIG. 14A includes a female profile 400 having a gap 402 formed between a lower leg 404 and an upper leg or locking extension 406 that are approximately parallel to one another. A vertical leg 408 extends from locking extension 406 approximately orthogonal thereto. Locking extension 406 includes a female locking or engagement tip 410. Female profile 400 includes a cutout 412 having a lip 414. Female profile 400 also includes a cutaway surface 416 having an indented region 418.

FIG. 14B illustrates a male profile 430 having a male profile leg or locking extension 432 and a vertical leg 434 extending therefrom. A fulcrum 436 is formed at the approximate intersection of locking extension 432 and vertical leg 434, and locking extension 432 extends from vertical leg 434, approximately orthogonal thereto. Locking extension 432 includes a male locking or engagement tip 438. Male profile 430 includes a cutout 440 having a lip 442. Vertical leg 434 includes a surface 444 having an indented region 446.

FIG. 14C illustrates a packing material 450 that is a relatively soft and compliant material, such as rubber having a range of 20-95 on the durometer A scale, as an example. However, other materials may apply as well for packing material 450, such as plastic and other materials. FIG. 14D illustrates a separator 460 that, in one example, is rubber having a range of 20-95 on the durometer A scale.

FIG. 14E illustrates a bar 470 having a first surface 472 and a second surface 474 that are tapered with respect to each other and not parallel with one another, forming a trapezoid in the illustrated example. That is bar 470 includes first and second surfaces 472, 474 that are opposite one another but are not parallel. Bar 470 is a hard material such as metal, and includes a hole 476. FIG. 14F illustrates a cladding material 480 that, in one example, is stainless steel. FIG. 14G illustrates a cladding or clip 490 having a first attachment region 492 and a second attachment region 494.

As will be illustrated, FIGS. 14A-14G illustrate components that may be used in different self-locking handrails assemblies, as will be further illustrated.

Figure 15:
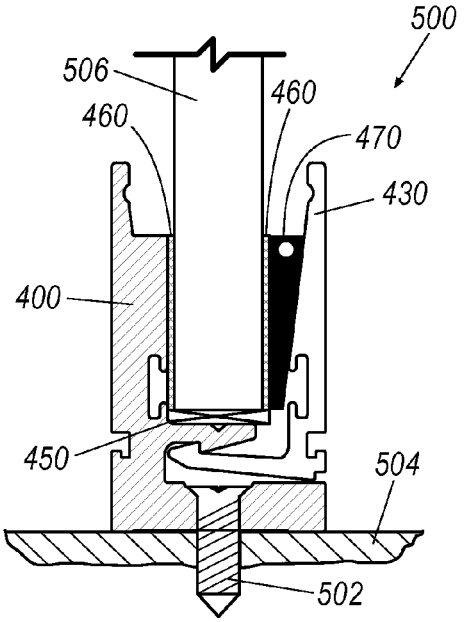
FIG. 15 illustrates a glass handrail assembly, according to one example.

Referring to FIG. 15, a glass handrail locking assembly 500 includes components illustrated in FIGS. 14A-14E. In assembly 500, female profile 400 is screwed via a screw 502 to a base material 504. Locking extension 432 of male profile 430 is positioned within gap 402, and profiles 400, 430 are engaged via female locking tip 410 and male locking tip 438. Packing 450 is positioned on an upper surface of locking extension 406. A glass handrail or panel 506 is positioned between vertical leg 408 and vertical leg 434. Separator 460 is positioned to both sides of panel 506, and bar 470 is positioned with its taper facing down or inward toward the assembly, such that its non-parallel surfaces 472, 474 wedge against male profile 430 and panel 506 (through rubber separator 460), causing female profile 400 and male profile 430 to engage by tilting vertical leg 430 outward from panel 506 and rotating about fulcrum 436 (resting on an upper surface of lower leg 404).

Bar 470 causes a mating action between female locking tip 410 and male locking tip 438, resulting in equal and opposite reactions that keep panel 506 in equilibrium between vertical leg 408 and vertical leg 434. Bar 470 includes hole 476 to provide an access location such that bar 470 may be removed from assembly 500 for disassembly or for replacing panel 506, as examples. That is, bar 470 is positioned between panel 506 and vertical leg 434, bar 470 having first and second surfaces 472, 474 opposite one another that are not parallel with one another, causing the female and male profiles 400, 430 to engage by tilting vertical leg 434 outward from panel 506 and about fulcrum 436. More specifically, because of the taper or non-parallel arrangement of surfaces 472, 474 of bar 470, male profile 430 is forced outward from panel 506 as bar 470 is pressed between panel 506 and vertical leg 434 of male profile 430, which causes male profile 430 to rotate about fulcrum 436 and tilt. Such tilting causes engagement of the profiles 400, 430 at their respective engagement tips 410, 438. Such engagement increases with increased insertion of bar 470, causing a self-locking action. The self-locking action increases yet further if external forces such as wind or other pressure are applied transversely to panel 506.

Figure 16:
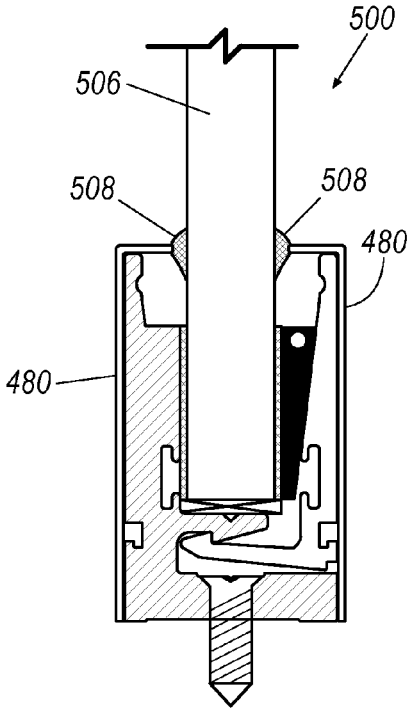
FIG. 16 illustrates a glass handrail assembly having a cladding material.

FIG. 16 illustrates a handrail assembly according to another example. Handrail assembly 500 of FIG. 15 includes, in this example, cladding material 480 of FIG. 14F that is attached to outer surfaces of assembly 500, the outer surfaces facing away from panel 506, to provide protection from the elements and to provide aesthetic improvement. In the illustrated example, each cladding material 480 is attached or coupled via a weather strip of silicon material, or beads 508 to respective sides or surfaces of panel 506. In one embodiment, the beads are a resilient material such as rubber.

Figure 17:
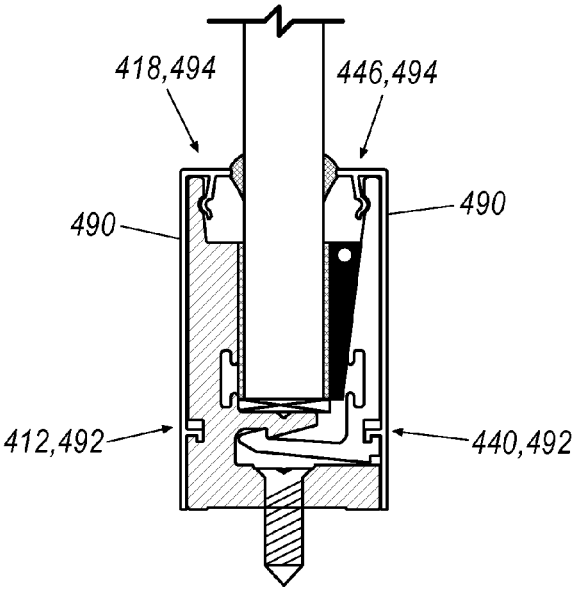
FIG. 17 illustrates a glass handrail assembly having a clip.

FIG. 17 illustrates a handrail assembly according to another example. Handrail assembly 500 of FIG. 15 includes, in this example, clip 490 of FIG. 14G that is retained to the assembly using first attachment region 492 that is attached to cutout 412 via lip 414, and another clip 490 is attached to cutout 440 via lip 442. Additionally, second attachment region 494 also attaches to cutaway surface 416 via indented region 418, and the other clip attaches via second attachment region 494 to surface 444 via indented region 446. That is, each of the claddings 490 is pressed against surfaces of the male profile and the female profile to retain them therein.

As such, a self-locking handrail system includes a female profile that includes a lower leg, a first locking extension that is approximately parallel to the lower leg, having a gap formed therebetween, and a first vertical leg extending from the first locking extension approximately orthogonal to the first locking extension. The system also includes a male profile that includes a second vertical leg, and a second locking extension extending from a free end of the second locking extension, forming a fulcrum. A panel is positioned between the first vertical leg and the second vertical leg. A bar is positioned between the panel and the second vertical leg, the bar having first and second surfaces opposite one another that are not parallel with one another, causing the female and male profiles to engage by tilting the second vertical leg outward from the panel and about the fulcrum.

Thus, in general, in the disclosed glass handrail locking systems, the glass panel remains in an equilibrium due to dynamism inherent in the locking system caused by the tensile nature of the metal profiles (aluminum), the cantilever function of the locking extension (of the female profile), and the leverage mechanism provided in the glazing system.

Furthermore, disclosed is a method of fabricating the glazing system. That is, a method of assembling the glazing system includes providing a female profile having a first leg, a first locking extension that is approximately parallel to the first leg, having a gap formed therebetween, the female profile including a first vertical leg that extends orthogonally from the first locking extension, and providing a male profile having a second vertical leg and a second locking extension that extends from a free end of the second vertical leg, forming a fulcrum. The method further includes positioning the second locking extension of the male profile within the gap of the female profile, positioning a panel between the first vertical leg and the second vertical leg, obtaining a bar having first and second surfaces opposite one another that are not parallel with one another, and positioning the first surface of the bar against the panel, and the second surface of the bar against the second vertical leg, causing the female and male profiles to engage by tilting the second vertical leg outward from the panel and about the fulcrum.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

While the disclosed subject matter has been described in detail in connection with only a limited number of embodiments, it should be readily understood that the disclosed subject matter is not limited to such disclosed embodiments. Rather, that disclosed can be modified to incorporate any number of variations, alterations, substitutions or equivalent arrangements not heretofore described, but which are commensurate with the spirit and scope of the disclosed subject matter. Additionally, while various embodiments have been described, it is to be understood that disclosed aspects may include only some of the described embodiments. Accordingly, that disclosed is not to be seen as limited by the foregoing description, but is only limited by the scope of the appended claims.

What is claimed is:

1. A self-locking handrail system comprising:

a female profile comprising:

a first leg positioned on a base material and attachable thereto;

a first locking extension that is approximately parallel to the first leg, having a gap formed therebetween, wherein the first leg is between the base material and the first locking extension; and a first vertical leg extending from the first locking extension approximately orthogonal to the first locking extension;

a male profile comprising:

a second vertical leg positioned opposite the first vertical leg; and a second locking extension extending from a free end of the second vertical leg, forming a fulcrum at an intersection region of the second locking extension and the second vertical leg, the second locking extension positioned within the gap;

a panel positioned between the first vertical leg and the second vertical leg; and a bar positioned between the panel and the second vertical leg, the bar having first and second surfaces opposite one another that are not parallel with one another, causing the female and male profiles to engage between a first locking tip of the first locking extension and a second locking tip of the second locking extension by tilting the second vertical leg outward from the panel and about the fulcrum.

2. The system of claim 1, wherein the bar is in a shape of a trapezoid.

3. The system of claim 1, wherein the fulcrum rests on the first leg of the female profile, and wherein the male profile rotates about the fulcrum.

4. The system of claim 1, wherein the first locking extension includes a first locking tip having a mating face extending toward the first leg, and the second locking extension includes a second locking tip having a dropping down face extending away from the first leg, and when the female and male profiles engage, they engage via the first and second locking tips.

5. The system of claim 4, wherein the bar causes a mating action between the first and second locking tips, resulting in equal and opposite reactions that keep the panel in equilibrium between the first vertical leg and the second vertical leg.

6. The system of claim 1, further comprising first and second separators positioned respectively between the panel and the first vertical leg, and between the panel and the second vertical leg.

7. The system of claim 1, wherein the bar includes a lifting hole for removing the bar from between the panel and the second vertical leg.

8. The system of claim 1, further comprising:

wherein:

the first and second vertical legs each include outer surfaces that face away from the panel;

the panel includes a first side and a second side that are opposite one another;

a first cladding is attached to the first side of the panel and coupled to the outer surface of the first vertical leg; and a second cladding is attached to the second side of the panel and coupled to the outer surface of the second vertical leg.

9. The system of claim 8, further comprising first and second rubber beads positioned respectively between:

the first cladding and the first side of the panel; and the second cladding and the second side of the panel.

10. The system of claim 8, wherein each of the first and second claddings includes respective clips that press against surfaces of the male profile and the female profile to retain the clips.

11. A method of assembling a self-locking handrail system, the method comprising:

providing a female profile having a first leg, a first locking extension that is approximately parallel to the first leg, having a gap formed therebetween, the female profile including a first vertical leg that extends orthogonally from the first locking extension;

positioning the first leg on a base material, such that the first leg is between the base material and the first locking extension;

providing a male profile having a second vertical leg that is opposite the first vertical leg, and a second locking extension that extends from a free end of the second vertical leg, forming a fulcrum at an intersection region of the second locking extension and the second vertical leg;

positioning the second locking extension of the male profile within the gap of the female profile;

positioning a panel between the first vertical leg and the second vertical leg;

obtaining a bar having first and second surfaces opposite one another that are not parallel with one another; and positioning the first surface of the bar against the panel, and the second surface of the bar against the second vertical leg, causing the female and male profiles to engage between a first locking tip of the first locking extension and a second locking tip of the second locking extension by tilting the second vertical leg outward from the panel and about the fulcrum.

12. The method of claim 11, further comprising positioning the male profile such that the male profile rests on the fulcrum such that the fulcrum is positioned on the first leg of the female profile.

13. The method of claim 11, wherein the first locking extension includes a female locking tip having a mating face extending toward the first leg, and the second locking extension includes a male locking tip having a dropping down face extending away from the first leg;

further comprising engaging the female and male profiles via the female and male locking tips.

14. The method of claim 11, further comprising:

attaching a first cladding to the panel via a first resilient bead;

coupling the first cladding to the female profile;

attaching a second cladding to the panel via a second resilient bead; and coupling the second cladding to the male profile.

15. The method of claim 14, wherein coupling the first cladding and coupling the second cladding further comprise coupling the first and second claddings via clips that are attached to the respective cladding.

16. A self-locking handrail system comprising:

a female profile comprising:

a lower leg and a first locking extension that form a gap therebetween, the lower leg positioned on a base material and attachable thereto; and a first vertical leg extending from the first locking extension;

a male profile comprising:

a second vertical leg opposite the first vertical leg, and a second locking extension that extends from a fulcrum formed between the second vertical leg and the second locking extension, the second locking extension extending into the gap of the female profile;

a panel positioned between the first vertical leg and the second vertical leg; and a bar having first and second surfaces opposite one another that are tapered with respect to one another;

wherein the first surface of the bar applies a first force against one surface of the panel, and the second surface of the bar applies a second force against the second vertical leg; and wherein the first locking extension and second locking extension are configured to engage between a first locking tip of the first locking extension and a second locking tip of the second locking extension due to application of the first and second forces.

17. The self-locking handrail system of claim 16, wherein the fulcrum rests on the lower leg of the female profile, and wherein the second locking extension is configured to rotate about the fulcrum.

18. The self-locking handrail system of claim 16, wherein the first locking extension includes a first locking tip having a mating face extending toward a first leg, and the second locking extension includes a second locking tip having a dropping down face extending away from the first leg, and when the female and male profiles engage, they engage via the first and second locking tips.

19. The self-locking handrail system of claim 16, further comprising first and second separators positioned respectively between the panel and the first vertical leg, and between the panel and the second vertical leg.

20. The self-locking handrail system of claim 16, further comprising:

a first cladding attached to a first side of the panel and coupled to an outer surface of the female profile;

a second cladding attached to a second side of the panel and coupled to an outer surface of the male profile; and first and second rubber beads positioned respectively between:

the first cladding and the first side of the panel; and the second cladding and the second side of the panel.

* * * * *